US006800175B2

(12) United States Patent
Spence et al.

(10) Patent No.: US 6,800,175 B2
(45) Date of Patent: Oct. 5, 2004

(54) PROCESS FOR MANUFACTURING A CELLULOSIC PAPER PRODUCT EXHIBITING REDUCED MALODOR

(75) Inventors: Tameka Spence, Lawrenceville, GA (US); Jason Patrick McDevitt, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 131 days.

(21) Appl. No.: 10/325,674

(22) Filed: Dec. 20, 2002

(65) Prior Publication Data

US 2004/0118537 A1 Jun. 24, 2004

(51) Int. Cl.[7] ..... D21H 17/05; D21H 21/00
(52) U.S. Cl. ..... 162/158; 162/207; 422/5
(58) Field of Search ..... 162/158, 207, 162/160; 422/5

(56) References Cited

U.S. PATENT DOCUMENTS

| | | | | |
|---|---|---|---|---|
| 3,744,496 A | * | 7/1973 | McCarty et al. | 131/342 |
| 4,002,486 A | | 1/1977 | Kotani et al. | |
| 4,013,479 A | * | 3/1977 | Biddle et al. | 106/147.6 |
| 4,021,493 A | | 5/1977 | Major et al. | |
| 4,187,251 A | | 2/1980 | Schleppnik | |
| 4,909,986 A | | 3/1990 | Kobayashi et al. | |
| 5,144,965 A | * | 9/1992 | Southwick | 131/276 |
| 5,144,967 A | * | 9/1992 | Cartwright et al. | 131/365 |
| 5,322,832 A | | 6/1994 | Takeyama et al. | |
| 5,330,961 A | | 7/1994 | Takeyama et al. | |
| 5,589,030 A | | 12/1996 | Sande et al. | |
| 5,607,551 A | | 3/1997 | Farrington, Jr. et al. | |
| 5,733,272 A | | 3/1998 | Brunner et al. | |
| 5,914,004 A | | 6/1999 | Kettunen et al. | |
| 6,149,767 A | | 11/2000 | Hermans et al. | |
| 6,197,154 B1 | | 3/2001 | Chen et al. | |

FOREIGN PATENT DOCUMENTS

| | | |
|---|---|---|
| EP | 0 251 132 B1 | 9/1990 |
| WO | WO 97/06306 | 2/1997 |
| WO | WO 97/06307 | 2/1997 |

OTHER PUBLICATIONS

International Search Report from PCT/US03/29172 dated Feb. 12, 2004.

Cullis, C.F., et al., "Combustion of Cigarette Paper Under Conditions Similar to Those During Smoking", *Cellulose & Its Derivatives*, 1985, Chapter 35, Kennedy et al., eds., Ellis Horwood Ltd.

Huat, L., "The Degradation of Cellulose in Paper Found in Library And Archive Materials", *The Brunei Museum Journal*, 1989, pp. 51–69, vol. 7, No. 1, Published by The Brunel Museum, Brunei Darussalam.

LeVan, S.L., "Chemistry of Fire Retardancy", *The Chemistry of Solid Wood*, 1984, Chapter 14, R. Rowell, editor, Advances in Chemistry Series 207 American Chemical Society.

Shafizadeh, F., "Thermal Degradation of Cellulose", *Cellulose Chemistry and its Applications*, 1985, Chapter 11, Nevell & Zeronian, eds., Ellis Horwood Ltd.

K.Wiik, et al., "Studies on Odour Reduction in TCF Bleached Packaging Paper", *Journal of Pulp and Paper Science*, Sep. 1998, vol. 24, No. 9.

* cited by examiner

*Primary Examiner*—Peter Chin
(74) *Attorney, Agent, or Firm*—Senniger Powers

(57) ABSTRACT

A process for manufacturing a cellulosic paper product (e.g., paper hand towels) exhibiting reduced malodor upon wetting. The process includes introducing a vanilla compound (e.g., vanillin) into the aqueous suspension of papermaking fibers from which the paper product is made, depositing the aqueous suspension of papermaking fibers onto a sheet-forming fabric to form a wet web and drying the wet web at high temperature in an oxidative environment to form a dried base sheet. The process of the present invention is particularly suited for reducing malodor released from cellulosic paper products made from through-air dried base sheet material.

32 Claims, No Drawings

PROCESS FOR MANUFACTURING A CELLULOSIC PAPER PRODUCT EXHIBITING REDUCED MALODOR

FIELD OF THE INVENTION

The present invention relates, in general, to processes for manufacturing cellulosic paper products and, more particularly, to such processes which provide cellulosic base sheets or finished products (e.g., hand towels) that release reduced malodor upon re-wetting.

BACKGROUND OF THE INVENTION

Commercial paper products such as hand towels are manufactured from cellulosic base sheets. A cellulosic base sheet is a paper product in its raw form prior to undergoing conventional post-treatments such as calendaring and embossing. In general, cellulosic base sheets are made by preparing an aqueous suspension of papermaking fibers and injecting or depositing the suspension onto an endless sheet-forming fabric to form a wet-laid web, which is then dewatered and dried to produce a base sheet suitable for finish processing.

Because of its commercial availability and practicality, through-drying is often used to dry base sheets. Through-drying involves removing water from a wet-laid web by passing a heated gas (e.g., air) through the web. More specifically, through-air drying typically comprises transferring a partially dewatered, wet-laid web from a sheet-forming fabric to a coarse, highly permeable through-drying fabric. A stream of heated air is passed through the wet web carried on the through-drying fabric as it runs over the high permeability rotating cylinder or drum of a through-drying apparatus. As the hot, dry air contacts the wet web, water is evaporated from the web and is transferred to the flow of drying air. Processes for making cellulosic base sheets including through-drying are described, for example, in U.S. Pat. No. 5,607,551 (Farrington et al.) and U.S. Pat. No. 6,149,767 (Hermans et al.), the entire disclosures of which are incorporated herein by reference.

It has been observed that a strong, burnt popcorn-like odor is sometimes emitted from finished paper hand towels when the towels are wetted (i.e., re-wetted after final drying of the base sheet from which the towel is made). Upon investigation, this problem of malodor release has been found to be particularly present in paper products made from cellulosic base sheets that have been through-air dried at relatively high air temperatures. It was hypothesized that over-drying or over-heating of the base sheets was leading to the malodor problem upon re-wetting of the paper product. By operating the through-air drying stage of a base sheet manufacturing process at a lower air temperature and compensating with slightly longer sheet residence time on the drying drum, the malodor problem can be largely eliminated. However, longer residence times in the through-drying apparatus adversely affect the overall productivity of the base sheet manufacturing process.

Therefore, what is lacking and needed in the art is a process which can reduce or eliminate malodor released upon re-wetting of paper products, particularly those made from through-air dried cellulosic base sheets, while allowing higher air drying temperatures and shorter dryer residence times to be used to increase product throughput and productivity.

SUMMARY OF THE INVENTION

Among the several objects of the present invention, therefore, is the provision of a process for manufacturing a cellulosic paper product from a wet-laid web; the provision of such a process wherein the paper product exhibits a reduced malodor upon re-wetting; the provision of such a process wherein the wet-laid web can be through-air dried at higher temperatures and shorter dryer residence times; the provision of such a process wherein productivity and throughput of the manufacturing process are increased; and the provision of such a process which is relatively inexpensive and easy to implement.

Briefly, therefore, the present invention is directed to a process for manufacturing a cellulosic paper product comprising forming an aqueous suspension of papermaking fibers, depositing the aqueous suspension of papermaking fibers onto a sheet-forming fabric to form a wet web and through-drying the wet web by passing a heated gas through the web. In accordance with the present invention, a vanilla compound is introduced into the aqueous suspension of papermaking fibers. The vanilla compound can be introduced into the aqueous suspension of papermaking fibers before or after the suspension is deposited onto the sheet-forming fabric. In accordance with a more particular embodiment of the present invention, the vanilla compound is introduced into the aqueous suspension of papermaking fibers in a solution containing a vanilla bean extractive and ethyl alcohol (e.g., vanilla bean extract), the aqueous suspension of papermaking fibers is deposited onto the sheet-forming fabric to form the wet web after introduction of the vanilla compound and the wet web is through-dried by passing air heated to a temperature of at least about 175° C. through the wet web.

Other objects and features of the present invention will be in part apparent and in part pointed out hereinafter.

DETAILED DESCRIPTION OF THE PREFERRED EMBODIMENTS

In accordance with the present invention, it has been discovered that a dried, cellulosic base sheet exhibiting reduced malodor upon re-wetting can be produced by introducing a vanilla compound such as vanillin (3-methoxy-4-hydroxybenzaldehyde) into an aqueous suspension of the cellulosic papermaking fibers from which the base sheet is formed. The wet-laid base sheets formed from such aqueous suspensions can be through-dried at higher drying gas temperatures and shortened dryer residence times while significantly reducing malodor produced upon re-wetting the dried base sheets or finished cellulosic paper products made from the base sheets (e.g., hand towels). That is, the previous strategy of employing lower through-drying gas temperatures to reduce malodor formation upon re-wetting is obviated by the practice of the present invention with concomitant improvement in process throughput and productivity.

While the generation of odor in pulp material is not fully understood, it is believed that the odor may be due to extractives in the pulp that are oxidized/reduced during the bleaching and drying process. As part of the present invention, possible reaction mechanisms in the base sheet manufacturing process that may be contributing to the presence of odorous compounds in through-air dried cellulosic base sheets have been investigated. Without being held to a particular theory, it is believed that malodor released upon re-wetting base sheets dried at high temperatures is caused by reactions that form volatile organic compounds or odor precursors during drying. It is believed that these odorous compounds are formed within a cellulosic base sheet during through-air drying and bound within the sheet until the moment that the sheet or a finished paper product made from the sheet is re-wetted. The combination of acid in the sheet and the addition of water upon re-wetting cleaves the odorous compounds from the sheet and releases the compounds into the environment. In particular, experience to date suggests that a large number of the odor-causing compounds released from re-wetted base sheet material can be characterized as medium chain aliphatic aldehydes (e.g., octanal, nonanal, decanal) and/or furans (e.g., furfural, furfuryl alcohol, hydroxymethyl furfural). Thus, it is believed that the presence of volatile aldehyde compounds and/or furan compounds, either alone or in combination, may be responsible for the base sheet malodor. These odor-causing compounds may be produced during high temperature drying of the wet web by any conventional means including Yankee dryers and through-air dryers, but are particularly problematic in through-air dried base sheets, perhaps due to the highly oxidative environment and unique mass transfer phenomena provided by the air stream passing through the web.

Experience to date with analyzing re-wetted base sheets, as described, for example, in Example 1 below, indicates that a substantial component of the malodor released from through-air dried cellulosic base sheets upon re-wetting comprises medium-chain, aliphatic aldehydes having from about 7 to about 10 carbon atoms. Without being bound by a particular theory, it is believed that the aldehydes are formed within the base sheet by the oxidation of fatty acids present in the aqueous suspension of papermaking fibers. For example, during chlorine dioxide bleaching, which is typically conducted under acidic conditions at a pH of about 3.5, fatty acids present in the aqueous suspension of papermaking fibers are either bound by ester linkages to carbohydrates or oxidized to smaller aliphatic aldehydes. Alternatively, aldehydes may be formed in the base sheet during high temperature air-drying, wherein bound fatty acids within the wet web can be oxidized to aliphatic aldehydes by heating.

As water is driven from the wet web during drying, a portion of the aliphatic aldehydes present in the wet web may react with vicinal diols present in the carbohydrates to form acetal linkages, thus binding the aldehydes to the sheet fibers. This acetal formation between the aliphatic aldehydes and vicinal diols in a wet web base sheet is a reversible reaction, with equilibrium between the free aldehyde and bound acetal depending upon the amount of water present. As water is being driven from the wet web, the reaction favors acetal formation. When water is added, and especially in the presence of acid, the acetal breaks down to an aldehyde. Therefore, it is believed that when the dried base sheet material is wetted with water (i.e., the sheet material is re-wetted), an acid-catalyzed reversal of the acetal formation reaction liberates the aldehyde, thus releasing the aldehyde from the base sheet material into the environment.

Analyses of organic extracts from re-wetted base sheets have also indicated the presence of furan components, in particular, furfural, furfuryl alcohol and hydroxymethyl furfural. These furans possess a burnt odor substantially similar to the odor released from the base sheets upon being re-wetted with water. Without being bound by a particular theory, it is believed that degradation of carbohydrates present in the base sheet occurs during through-air drying, to generate a furan precursor attached to the carbohydrates. The furan precursor is then liberated and released by an acid-catalyzed reaction when the base sheet material is re-wetted with water. While the liberation step could theoretically occur during further air-drying, it is believed that a rapid loss of water essentially leaves little or no solvent for subsequent reaction.

As is known, natural fragrances, such as the essential oils, have been used in the perfume industry to create a variety of acceptable odors. One art form of this industry is to use these fragrances to develop perfumes to treat odors that are repulsive to the human nose. Odors are measured by their intensity and one can vary greatly from another. In an attempt to modify an odor, it can either be masked or counteracted. Masking reduces olfactory perception of a malodor due to the presentation of another odor substance. Counteracting is defined as neutralizing an odor by the mixture of two odor substances that combine to form a less intense or objectionable odor than when the two are separated. Materials that are categorized as odor counteractants are often highly polar organic compounds and may have low vapor pressure.

As noted above, it has been observed that a strong, burnt popcorn-like odor is sometimes emitted when water contacts paper hand towels made from cellulosic base sheets that have been through-air dried at relatively high air temperatures. In accordance with the present invention, it has been discovered that introducing a vanilla compound into an aqueous slurry or suspension of papermaking fibers prior to high temperature drying of the wet-laid web in an oxidative environment (e.g., through-air drying) counteracts and substantially reduces the release of malodor upon wetting (i.e., re-wetting) of the dried base sheet material in the final product. A vanilla compound may function as a counteractant for odorous compounds that are highly polar and have been oxidized during the pulping process.

By vanilla compound it is meant vanillin and other vanilla bean extractives and related compounds including, vanillic acid (3-methoxy-4-hydroxybenzoic acid), ethyl vanillin (3-ethoxy-4-hydroxybenzaldehyde) and glucovanillin (3-methoxy-4-(β-D-glucopyranosyloxy)benzaldehyde). Two or more vanilla compounds may be introduced into the aqueous suspension of papermaking fibers. For example, commercially available vanilla bean extract comprising vanillin and an assortment of other vanilla bean extractives may be introduced into the aqueous suspension of papermaking fibers as the source of one or more vanilla compounds. In accordance with a preferred embodiment, vanillin, alone or in combination with other vanilla compounds, is used in the practice of the present invention.

The amount vanilla compound employed should be sufficient to substantially inhibit the formation of undesirable odors when cellulosic paper products (e.g., hand towels) formed from the dried base sheet are re-wetted. In general, suitable results are obtained by adding the vanilla compound to the aqueous suspension of papermaking fibers in an amount of at least about 1% by weight based on the weight of papermaking fibers present in the aqueous suspension. Preferably, the quantity of vanilla compound introduced into the aqueous suspension of paper making fibers is from about 1% to about 25%, more preferably, from about 5% to about 20% by weight based on the weight of papermaking fibers present in the aqueous suspension.

In order to facilitate introduction and dispersion of the vanilla compound into the aqueous suspension of papermaking fibers, it is preferred that the vanilla compound be added to the suspension in a solution comprising a polar solvent. Any polar solvent in which the vanilla compound is sufficiently soluble and that is otherwise compatible with the papermaking process may be employed as the solvent carrier for the vanilla compound. Suitable polar solvents include water, alcohols and aqueous alcoholic solutions. For example, the vanilla compound added to the suspension of papermaking fibers may be dissolved in a solvent comprising a lower alkanol such as methyl alcohol, ethyl alcohol, propyl alcohol, isopropyl alcohol or butyl alcohol. As alluded to above, the vanilla compound is suitably obtained from vanilla beans (e.g., Vanilla planifolia and Vanilla tahitensis) using conventional extraction techniques (e.g., percolating or macerating chopped vanilla beans with ethyl alcohol and water) and introduced into the aqueous suspension of papermaking fibers as a component of commercially available vanilla bean extract comprising vanillin and other vanilla bean extractives dissolved in an aqueous solution comprising ethyl alcohol used in the extraction process. Sugar, corn syrup, caramel, colors and stabilizers may also be present in commercially available vanilla bean extracts. Preferably, a pure vanilla bean extract is used as a source of the vanilla compound added to the aqueous suspension of papermaking fibers.

It should be understood that the use of a polar solvent is simply a preferred expedient for introducing the vanilla compound into the aqueous suspension of papermaking fibers and that the practice of the present invention does not require that the vanilla compound be dispersed in a polar solvent so long as it is added to the aqueous suspension of papermaking fibers in an unhindered, chemically reactive state so that it can beneficially counteract the production of malodor in the dried base sheet. For example, one or more vanilla compounds may be added to the aqueous suspension of papermaking fibers as a solid (e.g., crystalline vanillin). Furthermore, although the vanilla compounds may be extracted or otherwise derived from vanilla beans, the vanilla compounds used in the practice of the present invention may be manufactured synthetically. For example, vanillin may be produced synthetically from eugenol or by oxidizing lignin or lignosulfonate resulting from the kraft and sulfite cooking processes used in the wood pulp industry.

As will be recognized by those skilled in the papermaking art, the present invention is widely applicable to cellulosic base sheet manufacturing processes that include high temperature drying of the wet-laid web in an oxidative environment (e.g., air), and particularly to those processes in which the wet web is subjected to through-air drying. The practice of the present invention is readily integrated into cellulosic base sheet manufacturing processes and does not materially alter conventional practices except as otherwise noted herein. Conventional papermaking apparatus and techniques can be used with respect to preparation of the aqueous suspension of papermaking fibers or furnish, including pulping and bleaching, the sheet-forming process and tackle, headbox, sheet-forming fabrics, web transfers, transfer fabrics, dewatering, drying, creping, etc. all of which are readily understood by those skilled in the art.

Suitable formation processes include Fourdrinier, roof farmers (such as suction breast roll), and gap formers (such as twin wire farmers, crescent farmers), or the like. Sheet-forming fabrics or wires can also be conventional, with the finer weaves with greater fiber support being preferred to produce a more smooth sheet or web and the coarser weaves providing greater bulk. Fourdrinier farmers are particularly useful for making the heavier basis weight sheets useful in the manufacture of paper hand towels and industrial wipers. Headboxes used to deposit the aqueous suspension of papermaking fibers onto the sheet-forming fabric can be layered or nonlayered.

The deposited wet-laid web is preferably partially dewatered before drying. Suitable partial dewatering techniques include vacuum dewatering (e.g., vacuum or suction boxes), air presses, and/or mechanical pressing operations.

The partially dewatered web may be dried by any means generally known in the art for making cellulosic base sheets, including, without limitation, Yankee dryers and through-air dryers. Preferably, a noncompressive drying method which tends to preserve the bulk or thickness of the wet web is employed. The present invention is particularly adapted for reducing objectionable odors emitted by through-air dried base sheets upon being re-wetted with water. Suitable through-drying apparatus and through-drying fabrics are conventional and well-known in the papermaking industry. The inclusion of a vanilla compound in the aqueous suspension of papermaking fibers counteracts the emission of malodor from the base sheet while permitting the use of desirably higher drying gas temperatures and shorter residence times in the through-drying apparatus, which in turn improves the productivity and throughput of the base sheet manufacturing process. Accordingly, it is preferred that the wet-laid web be through-dried by passing air or other drying gas heated to a temperature of at least about 175° C. through the web. More preferably, the air passed through the web is heated to a temperature of at least about 180° C., more preferably at least about 190° C. Typically, the drying gas temperature for a through-drying operation will be from about 190° to about 220° C., more preferably from about 190° to about 210° C. and especially from about 200° to about 205° C. One skilled in the art can readily determine the optimum drying gas temperature and sheet residence time for a particular through-drying operation.

Papermaking fibers useful in the process of the present invention include any cellulosic fibers that are known to be useful for making cellulosic base sheets. Suitable fibers include virgin softwood and hardwood fibers along with non-woody fibers, as well as secondary (i.e., recycled) papermaking fibers and mixtures thereof in all proportions. Non-cellulosic synthetic fibers can also be included in the aqueous suspension. Papermaking fibers may be derived from wood using any known pulping process, including kraft and sulfite chemical pulps.

In addition to the vanilla compound, the aqueous suspension of papermaking fibers may contain various additives conventionally employed by those skilled in the art, including, without limitation, wet strength resins (e.g., KYMENE, Hercules, Inc.), fillers and softening agents or debonders.

It is contemplated that the vanilla compound may be introduced into the aqueous suspension of papermaking fibers at any time during the base sheet manufacturing process prior to final drying of the wet-laid web. For example, the vanilla compound may be introduced into the aqueous suspension of papermaking fibers by applying it to the wet-laid web as it travels from the forming section to the drying section of the base sheet manufacturing process. In such an embodiment, the vanilla compound is suitably dissolved in a polar solvent and the resulting solution sprayed onto the wet-laid web as the web is conveyed past one or more sprayers on the base sheet manufacturing line. The wet web may be partially dewatered prior to the introduction of the vanilla compound. For example, the vanilla compound may be applied (e.g., sprayed) onto the wet web having a dry weight consistency of from about 20% to about 80% (e.g., 25%, 30%, 35%, 40%, 50%, 60%, 70% or 80%). It is important to apply the vanilla compound uniformly across the wet web to enhance dispersion of the vanilla compound throughout the aqueous suspension of papermaking fibers. However, introducing the vanilla compound into the aqueous suspension of papermaking fibers after formation of the wet-laid web is somewhat less preferred in the practice of the present invention because it is difficult to ensure that the vanilla compound is adequately dispersed throughout the wet laid web in the relatively short time that elapses between web formation and final drying.

In accordance with a preferred embodiment, the vanilla compound is introduced into the aqueous suspension of papermaking fibers prior to depositing the suspension onto the sheet-forming fabric to form the wet-laid web. Introducing the vanilla compound into the aqueous suspension of papermaking fibers prior to web formation facilitates dispersion of the vanilla compound throughout the suspension and longer contact between the vanilla compound and the fibers contained therein so that the beneficial effects with respect to odor reduction in the dried base sheet are enhanced. The vanilla compound may be added to the aqueous suspension of papermaking fibers along with conventional additives, such as wet strength resins, which are typically introduced after bleaching and washing of the pulp and before web formation. For example, the vanilla compound may be suitably added to the aqueous suspension of papermaking fibers in the pulper/machine chest, refiner, furnish tank or other appropriate apparatus used in working up the suspension of papermaking fibers fed to the headbox from which the wet web is deposited. Preferably, the vanilla compound is introduced into the aqueous suspension of papermaking fibers while the suspension is being stirred or otherwise agitated in such apparatus to further enhance dispersion of the vanilla compound throughout the suspension within a reasonable residence time. In the preferred embodiment where the vanilla compound is introduced before web formation, the aqueous suspension of papermaking fibers into which the vanilla compound is introduced typically has a dry weight consistency of no greater than about 20%, more preferably no greater than about 5% and especially no greater than about 2%.

Individual cellulosic paper products made from the base sheets in accordance with the present invention may, include, for example, absorbent hand towels, industrial wipers, tissues, napkins and the like of one or more plies and varying finish basis weights. For multi-ply products, it is not necessary that all plies of the product be the same, provided that at least one ply is made in accordance with the present invention. Suitable basis weights for these products can be from about 5 to about 70 grams/$m^2$. In accordance with a preferred embodiment, the cellulosic paper products have a finish basis weight ranging from about 25 to about 45 grams/$m^2$, even more preferably from about 30 to about 40 grams/$m^2$.

The process of the present invention has not been found to significantly alter the physical properties of the cellulosic base sheet products produced by the process in any capacity other the substantial reduction in the release of malodor upon re-wetting. For example, through-dried cellulosic base sheets produced by the process of the invention generally contain an amount of stretch of from about 5 to about 40 percent, preferably from about 15 to about 30 percent. Further, products of this invention can have a machine direction tensile strength of about 1000 grams or greater, preferably about 2000 grams or greater, depending on the product form, and a machine direction stretch of about 10 percent or greater, preferably from about 15 to about 25 percent. More specifically, the preferred machine direction tensile strength for products of the invention may be about 1500 grams or greater, preferably about 2500 grams or greater. Tensile strength and stretch are measured according to ASTM D1117-6 and D1682. As used herein, tensile strengths are reported in grams of force per 3 inches (7.62 centimeters) of sample width, but are expressed simply in terms of grams for convenience.

The aqueous absorbent capacity of the products of this invention is at least about 500 weight percent, more preferably about 800 weight percent or greater, and still more preferably about 1000 weight percent or greater. It refers to the capacity of a product to absorb water over a period of time and is related to the total amount of water held by the product at its point of saturation. The specific procedure used to measure the aqueous absorbent capacity is described in Federal Specification No. UU-T-595C and is expressed, in percent, as the weight of water absorbed divided by the weight of the sample product.

The products of this invention can also have an aqueous absorbent rate of about 1 second or less. Aqueous absorbent rate is the time it takes for a drop of water to penetrate the surface of a base sheet in accordance with Federal Specification UU-P-31b.

Still further, the oil absorbent capacity of the products of this invention can be about 300 weight percent or greater, preferably about 400 weight percent or greater, and suitably from about 400 to about 550 weight percent. The procedure used to measure oil absorbent capacity is measured in accordance with Federal Specification UUT 595B.

The products of this invention exhibit an oil absorbent rate of about 20 seconds or less, preferably about 10 seconds or less, and more preferably about 5 seconds or less. Oil absorbent rate is measured in accordance with Federal Specification UU-P-31b.

The following examples are simply intended to further illustrate and explain the present invention. This invention, therefore, should not be limited to any of the details in these examples.

EXAMPLE 1

This example demonstrates an experiment designed to determine the relative odor intensity of compounds released from through-dried cellulosic base sheets manufactured by a conventional Un-Creped Through-Air Dried (UCTAD) process without addition of a vanilla compound to the aqueous suspension of papermaking fibers. The experiment employed a CHARM analysis to determine the relative odor intensity of each compound. The CHARM protocol is described generally, for example, by Acree et al. in *Food Chem.,* 184:273–86 (1984), which is incorporated herein by reference. As described by Acree et al., the CHARM analysis comprises sequentially diluting a series of samples to determine the strongest smelling components of a sample.

The experiment comprised wetting samples of through-dried cellulosic base sheets (ranging from about 6 to about 20 g of pulp) with water. The gases evolved from the wetted base sheets were concentrated onto a sorbent trap commercially available from Envirochem, Inc. and containing 150 mg each of glass beads/Tenax TA/Ambersorb/charcoal and then thermally desorbed into a gas chromatograph (GC) (such as a HP 5890 GC commercially available from Hewlett-Packard, Inc.) and/or a gas chromatograph/mass spectrometer (GC/MS) (such as a HP 5988 commercially available from Hewlett-Packard, Inc.). The gas chromatograph was also fitted with a sniffer port to allow the operator to determine if the eluted compounds had an odor, a procedure described as gas chromatograph olfactometry (GCO). Each eluted compound that produced an odor at the sniffer port was recorded. A voice actuated tape recorder was used to record sensory impressions. The sample was then diluted and analyzed again.

Different sample sizes were analyzed until no odor components could be detected. The largest sample size (16 g) was analyzed three times to ensure that all odorous compounds were detected. Thereafter, only the retention times of compounds determined to be odorous were evaluated in duplicate. Each successive sample was diluted to comprise one-third the amount of material of the previous sample.

Results and Discussion

The GC/MS' chromatograms indicated that numerous compounds were evolved from the re-wetted through-dried cellulosic base sheets. In a typical analysis, each peak of the chromatograms would be assigned to a particular chemical and a literature search would be undertaken to determine which of the chemicals have an odor. Since relatively few compounds have published odor thresholds, it would be difficult to determine whether an individual chemical would be odorous at the concentrations present in the sample. Thus, the ability to determine which peaks are odorous using GCO greatly simplifies the task of identifying the compounds responsible for the odor.

From all the compounds detected, only 17 peaks were found to possess an odor by GCO. CHARM analysis determined that two peaks accounted for more than 70% of the odor intensity, with four peaks comprising 85% of the odor intensity. From the combination of CHARM and GC/MS analysis, it is clear that the odor can be attributed to aldehydes. The most odorous compounds appear to be $C_7$–$C_{10}$ aldehydes (e.g., octanal, nonanal, and decanal) which have odor thresholds typically ranging from about 100 parts per trillion (ppt) to about 3 parts per billion (ppb).

EXAMPLE 2

This example demonstrates the introduction of a vanilla compound into an aqueous suspension of papermaking fibers as a treatment for reducing malodor released by re-wetting dried handsheets made from the papermaking fibers.

The vanilla compound was introduced into the aqueous suspension of papermaking fibers as a component of commercially available bourbon vanilla bean extract comprising vanillin and other vanilla bean extractives dissolved in an aqueous solution of 35% ethyl alcohol. Recycled paper fibers (1.2 grams) were blended with 120 ml of water and the mixture combined with approximately 3000 ml of water in a laboratory handsheet mold operable to selectively drain liquid through a porous mesh bottom. Approximately, 3 grams of the vanilla bean extract was added directly to the aqueous suspension of papermaking fibers in the mold prior to sheet formation. The aqueous suspension of fibers in the mold was agitated both before and after introduction of the vanilla bean extract. Liquid was then allowed to drain through the mesh bottom of the mold and the resulting web was wet pressed to a fiber consistency of about 70%. After air-drying to a fiber consistency of from about 93% to about 99%, the web was further dried in an oven at a temperature of about 190° C. for varying periods of time. An untreated handsheet (i.e., without addition of vanilla bean extract) was prepared for purposes of comparison. The dried sheets were then re-wet with a misting spray of water (about 3.5 ml) and observed for odor. The results are set forth in Table 1 below.

TABLE 1

| Sample No. | Treatment | Drying Time (minutes) | Odor |
|---|---|---|---|
| 1 | vanilla extract (3 grams) | 10 | faint burnt odor |
| 2 | vanilla extract (3 grams) | 17–20 | faint burnt odor |
| 3 | vanilla extract (3 grams) | 15 | very faint burnt odor |
| 4 | untreated | 10 | strong odor |

Based upon the test results, the addition of vanilla bean extract to the aqueous suspension of papermaking fibers prior to handsheet formation appeared to significantly mask or counteract the odor released upon re-wetting the dried handsets.

EXAMPLE 3

The procedure described in Example 2 was repeated except that the amount of vanilla bean extract introduced into the aqueous suspension of papermaking fibers in the handsheet mold was varied and the handsheets were dried at an oven temperature of about 205° C. for 20 minutes. The dried sheets were re-wet with a misting spray of water and the relative odor released by the re-wetted handsheets was assessed by a single person using paired comparison between the treated and untreated samples. The odor ranking 1 (least odor detected) to 5 most odor detected) is set forth in Table 2 below.

TABLE 2

| Sample No. | Treatment | Drying Time (minutes) | Odor Ranking 1–5 (best to worst) |
|---|---|---|---|
| 1 | vanilla extract (1 gram) | 20 | 3 |
| 2 | vanilla extract (0.3 gram) | 20 | 4 |
| 3 | vanilla extract (2 grams) | 20 | 2 |
| 4 | vanilla extract (3 grams) | 20 | 1 |
| 5 | untreated | 20 | 5 |

In view of the above, it will be seen that the several objects of the invention are achieved and other advantageous results attained.

The present invention is not limited to the above embodiments and can be variously modified. The above description of the preferred embodiments, including the Examples, is intended only to acquaint others skilled in the art with the invention, its principles, and its practical application so that others skilled in the art may adapt and apply the invention in its numerous forms, as may be best suited to the requirements of a particular use.

With reference to the use of the word(s) comprise or comprises or comprising in this entire specification (including the claims below), unless the context requires otherwise, those words are used on the basis and clear understanding that they are to be interpreted inclusively, rather than exclusively, and that each of those words is to be so interpreted in construing this entire specification.

What is claimed is:

1. A process for manufacturing a cellulosic paper product, the process comprising:

forming an aqueous suspension of papermaking fibers;

introducing a vanilla compound into said aqueous suspension of papermaking fibers;

depositing said aqueous suspension of papermaking fibers onto a sheet-forming fabric to form a wet web; and through-drying said wet web by passing a heated gas through said wet web.

2. A process as set forth in claim 1 wherein said vanilla compound is selected from the group consisting of vanillin, vanillic acid, ethyl vanillin, glucovanillin and mixtures thereof.

3. A process as set forth in claim 2 wherein said vanilla compound is vanillin.

4. A process as set forth in claim 2 wherein said vanilla compound is introduced into said aqueous suspension of papermaking fibers in an amount of at least about 1% by weight based on the weight of papermaking fibers in said aqueous suspension.

5. A process as set forth in claim 4 wherein said vanilla compound is introduced into said aqueous suspension of papermaking fibers in an amount of from about 1% to about 25% by weight based on the weight of papermaking fibers in said aqueous suspension.

6. A process as set forth in claim 5 wherein said vanilla compound is introduced into said aqueous suspension of papermaking fibers in an amount of from about 5% to about 20% by weight based on the weight of papermaking fibers in said aqueous suspension.

7. A process as set forth in claim 2 wherein said vanilla compound introduced into said aqueous suspension of papermaking fibers is dissolved in a solution comprising a polar solvent.

8. A process as set forth in claim 7 wherein said solution comprises a lower alkanol.

9. A process as set forth in claim 8 wherein said solution comprises ethyl alcohol.

10. A process as set forth in claim 2 wherein said vanilla compound is extracted from vanilla beans and introduced into the aqueous suspension of papermaking fibers as a component of vanilla bean extract comprising the vanilla compound dissolved in an aqueous solution comprising ethyl alcohol.

11. A process as set forth in claim 2 wherein said vanilla compound is introduced into said aqueous suspension of papermaking fibers prior to depositing said aqueous suspension onto said sheet-forming fabric.

12. A process as set forth in claim 2 wherein said aqueous suspension of papermaking fibers into which said vanilla compound is introduced has a dry weight consistency of no greater than about 20%.

13. A process as set forth in claim 12 wherein said aqueous suspension of papermaking fibers into which said vanilla compound is introduced has a dry weight consistency of no greater than about 5%.

14. A process as set forth in claim 13 wherein said aqueous suspension of papermaking fibers into which said vanilla compound is introduced has a dry weight consistency of no greater than about 2%.

15. A process as set forth in claim 2 wherein said wet web is partially dewatered prior to through-drying said wet web.

16. A process as set forth in claim 2 wherein said wet web is through-dried by passing air heated to a temperature of at least about 175° C. through said wet web.

17. A process as set forth in claim 16 wherein the air passed through said wet web is heated to a temperature of at least about 180° C.

18. A process as set forth in claim 17 wherein the air passed through said wet web is heated to a temperature of at least about 190° C.

19. A process as set forth in claim 18 wherein the air passed through said wet web is heated to a temperature of from about 190° to about 210° C.

20. A process as set forth in claim 19 wherein the air passed through said wet web is heated to a temperature of from about 200° to about 205° C.

21. A process for manufacturing a cellulosic paper product, the process comprising:

forming an aqueous suspension of papermaking fibers;

introducing an aqueous solution containing a vanilla bean extractive and ethyl alcohol into said aqueous suspension of papermaking fibers;

depositing said aqueous suspension of papermaking fibers containing said vanilla bean extractive onto a sheet-forming fabric to form a wet web; and through-drying said wet web by passing air heated to a temperature of at least about 175° C. through said wet web.

22. A process as set forth in claim 21 wherein said vanilla bean extractive comprises vanillin.

23. A process as set forth in claim 22 wherein said vanilla bean extractive is introduced into said aqueous suspension of papermaking fibers in an amount of at least about 1% by weight based on the weight of papermaking fibers in said aqueous suspension.

24. A process as set forth in claim 23 wherein said vanilla bean extractive is introduced into said aqueous suspension of papermaking fibers in an amount of from about 1% to about 25% by weight based on the weight of papermaking fibers in said aqueous suspension.

25. A process as set forth in claim 24 wherein said vanilla bean extractive is introduced into said aqueous suspension of papermaking fibers in an amount of from about 5% to about 20% by weight based on the weight of papermaking fibers in said aqueous suspension.

26. A process as set forth in claim 22 wherein said aqueous suspension of papermaking fibers into which said vanilla bean extractive is introduced has a dry weight consistency of no greater than about 5%.

27. A process as set forth in claim 26 wherein said aqueous suspension of papermaking fibers into which said vanilla bean extractive is introduced has a dry weight consistency of no greater than about 2%.

28. A process as set forth in claim 22 wherein said wet web is partially dewatered prior to through-drying said wet web.

29. A process as set forth in claim 22 wherein the air passed through said wet web is heated to a temperature of at least about 180° C.

30. A process as set forth in claim 29 wherein the air passed through said wet web is heated to a temperature of at least about 190° C.

31. A process as set forth in claim 30 wherein the air passed through said wet web is heated to a temperature of from about 190° to about 210° C.

32. A process as set forth in claim 31 wherein the air passed through said wet web is heated to a temperature of from about 200° to about 205° C.

* * * * *